United States Patent [19]

Eckert et al.

[11] Patent Number: 4,634,076

[45] Date of Patent: Jan. 6, 1987

[54] BOBBIN AND METHOD OF WINDING SAID BOBBIN

[76] Inventors: Robert L. Eckert, 11231 Foster Rd., Los Alamitos, Calif. 90720; Walter T. Gorrell, 625 E. 10th St., Azusa, Calif. 91702

[21] Appl. No.: 754,547

[22] Filed: Jul. 15, 1985

[51] Int. Cl.[4] ..... B65H 75/02; B65H 75/24; B65D 85/00

[52] U.S. Cl. ..... 242/118.7; 206/403; 242/118.2

[58] Field of Search ..... 242/118, 55.19, 118.1, 242/118.11, 118.2, 118.4, 118.41, 118.32, 118.7, 115, 116, 125, 125.1, 125.2, 125.3, 199; 228/191, 264, 19; 206/398, 403

[56] References Cited

U.S. PATENT DOCUMENTS

| | | | |
|---|---|---|---|
| 3,136,415 | 6/1964 | Sandstrom | 206/403 |
| 3,212,729 | 10/1965 | Putman | 206/403 X |
| 3,430,886 | 3/1969 | Sweeney | 242/118.41 X |
| 3,601,654 | 8/1971 | Long | 242/199 |
| 3,726,464 | 4/1973 | Howell | 228/19 |
| 4,382,565 | 5/1983 | Shiba | 242/55.19 X |

*Primary Examiner*—Donald Watkins
*Attorney, Agent, or Firm*—Nilsson, Robbins, Dalgarn, Berliner, Carson & Wurst

[57] ABSTRACT

A bobbin for desoldering braid includes a hub and heads extending outwardly at the end of the hub. One head has a curling portion of flexible material establishing a surface in overlying and spaced relationship to the peripheral edge of the other radially extending flat head to cover the winding of braid on the hub when curled inwardly to a closed position and extending away from the flat head to expose the winding when curled to an open position. The hub is formed with a slot which can be narrowed by applying pressure to the ends of the hub in order to hold the end of the braid during winding. Upon release of the pressure the end of the braid is released from the slot and the winding of braid is held loosely between the heads of the bobbin. The braid is thereby permitted to slip during unwinding by pulling the braid straight out from the bobbin with a minimum of friction between the braid and the heads of the bobbin. The bobbin is optionally fabricated of a conductive plastic material to prevent electrostatic discharges.

12 Claims, 9 Drawing Figures

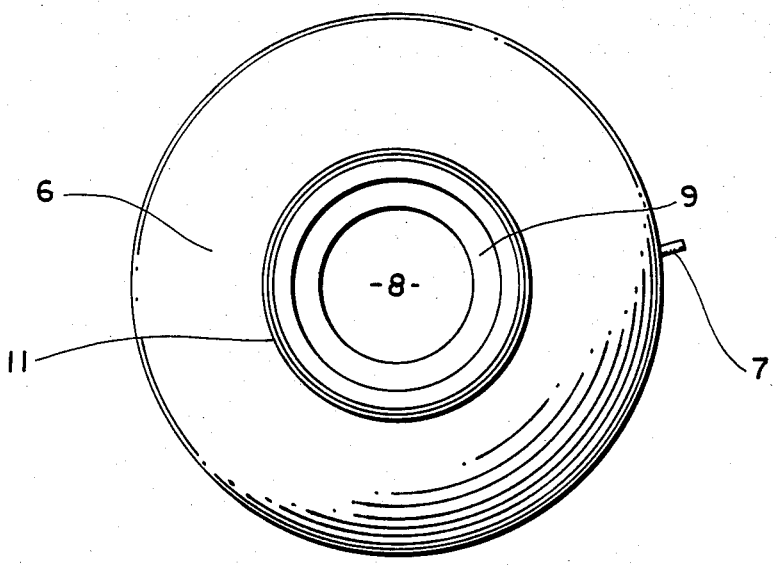
FIG. 4
FIG. 5
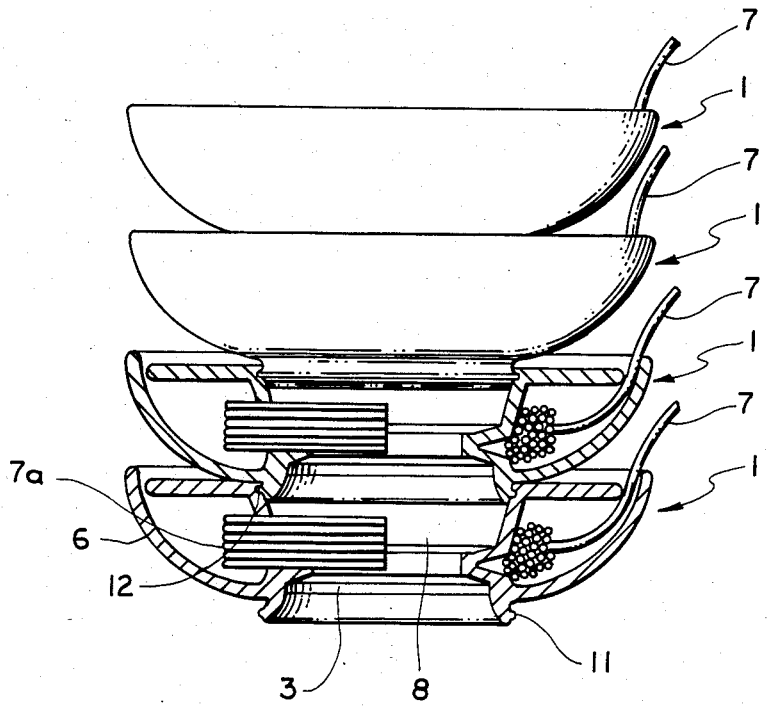
FIG. 6
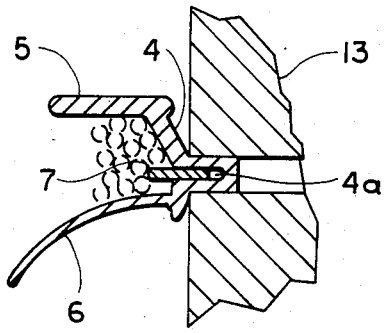
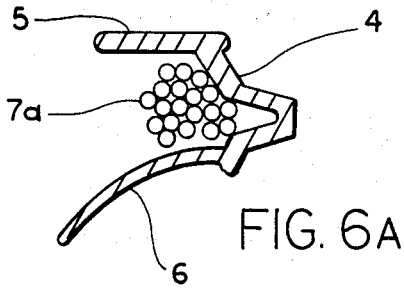
FIG. 6A

FIG. 7
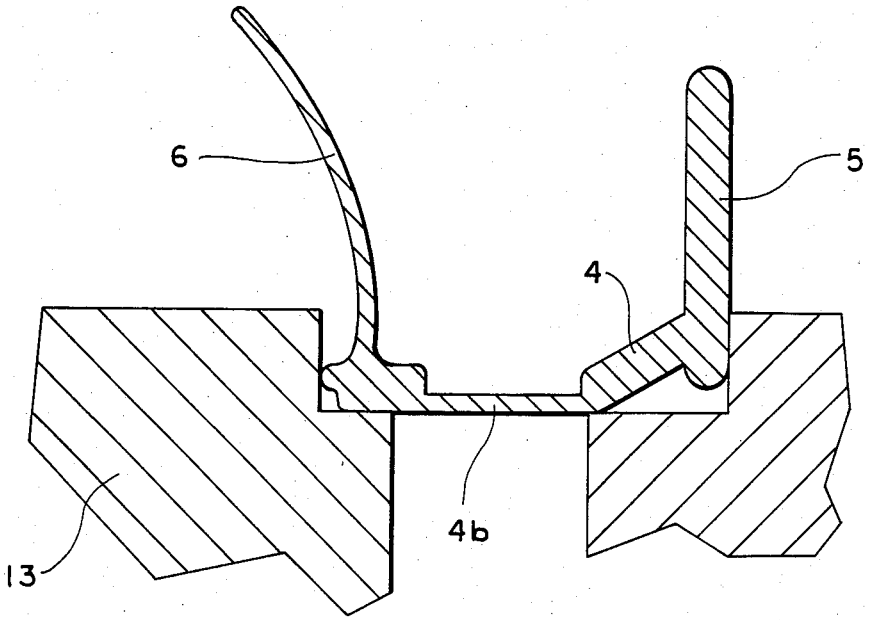
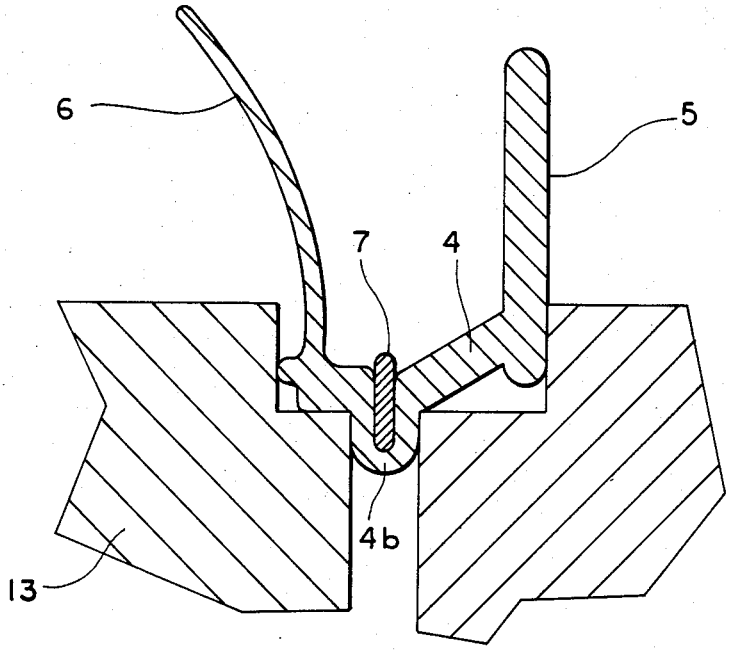
FIG. 8

BOBBIN AND METHOD OF WINDING SAID BOBBIN

FIELD OF THE INVENTION

This invention relates to bobbins for holding desoldering braid and similar metallic filaments.

BACKGROUND AND SUMMARY OF THE INVENTION

In the manufacture and maintenance of electronic assemblies as well as other electrical apparatus the need frequently arises to remove a quantity of solder as for example to disconnect an electrical component from a printed circuit board. While various techniques have been employed in the past to remove such solder, one accepted method that is in widespread use involves the capillary action of metallic braid to draw molten solder from a work-piece. Forms of such desoldering braid and its uses are disclosed in U.S. Pat. Nos. 3,627,191 and 3,715,797. A desoldering braid having a loose flattened tubular configuration is described in co-pending application of Jesse C. Hood, Ser. No. 457,837 filed Jan. 14, 1983. A process for producing desoldering braid of such loose configuration is described in co-pending application of Jesse C. Hood, Ser. No. 457,838, now abandoned filed Jan. 14, 1983.

There are several advantages attendant upon the use of desoldering braid. For example, the technique of using the braid, as in conjunction with a soldering iron, is somewhat related to the activity of soldering and is, therefore, familiar to technicians in the field. Furthermore, removing solder by the use of desoldering braid is relatively fast and effective and the removed solder is captured and held in the braid. Consequently, loose particles of solder are not left about an electrical apparatus.

To use the desoldering braid, a section of braid is first placed over the unwanted solder. The braid so positioned is contacted with a soldering iron to heat the braid and melt the solder. Capillary action of the desoldering braid then draws the molten solder in the braid removing it from the undesired location.

Desoldering braid is generally furnished wound around a spool or bobbin. One form of bobbin acceptable for this purpose is described in U.S. Pat. No. 3,430,886, the disclosure of which is hereby incorporated by reference.

Bobbins provide support for desoldering braid and permit quick and easy winding of the braid thereon and removal of the braid therefrom.

For best results, a bobbin for desoldering braid should be small in size and compact to permit carriage in a tool box or similar receptacle or on the person such as in a pocket. It should permit the manufacturer to easily wind the braid thereon and the user to readily remove the braid for use in desoldering. Heretofore, bobbins for desoldering braid such as the bobbin disclosed in U.S. Pat. No. 3,430,886, mentioned above, have not provided any means for securing the end of the desoldering braid to the bobbin during winding of the braid onto the bobbin. The loose end of the braid tends to slip as the bobbin is wound with the braid until the end is caught by the braid being wound upon it. Thus, commencing the winding of the braid upon the bobbin is somewhat cumbersome and does not result in uniformly wound bobbins.

In addition, it has been observed that as the braid is pulled from the bobbin, friction between the desoldering braid, which is metallic or at least has a metallic outer surface, and the bobbin, which is generally fabricated from a plastic material, can produce electrostatic discharges, which may be destructive of sensitive electronic equipment upon which the desoldering braid is being used.

Accordingly, it is an object of the present invention to provide a bobbin for desoldering braid which has none of the previously mentioned disadvantages.

Another object of this invention is to provide a bobbin construction which will prevent the end of the braid from slipping during winding of the braid upon the bobbin.

Another object of the invention is to eliminate friction between the desoldering braid and the bobbin when the braid is pulled from the bobbin.

Another object of the present invention is to provide a bobbin in which friction between the desoldering braid and the bobbin does not result in the production of electrostatic discharges.

Other objects, advantages and capabilities of the invention will become apparent from the following description taken in conjunction with the accompanying drawings in which like parts bear similar reference numerals.

The bobbin of the present invention includes a body having a hub portion for holding and supporting a winding of desoldering braid, first head having a substantially flat portion extending outwardly from one end of the hub portion and a second head having a curling portion of a flexible material extending outwardly from the other end of the hub portion and establishing a surface portion overlying and in close tolerance with the peripheral edge of the flat head portion, so as to enclose a winding of the braid on the hub portion when curled inwardly to a first position, and extending outwardly from the hub portion in substantially spaced relation to the first head portion when curled outwardly to a second position, to prevent winding of the braid on the hub portion. The hub portion contains a slot wider than the braid for receiving an end of the braid and adapted to be narrowed by applying pressure to the ends of the hub portion to hold securely an end of the braid and to narrow the distance between the heads during winding of the braid upon the compressed hub portion and to be widened and to cause the distance between the heads to be widened to their normal widths upon ceasing the application of pressure to the ends of the hub portion. The end of the braid is thereby released from the slot and the braid is supported loosely upon the hub portion between the heads. The bobbin may be fabricated of a conductive plastic material to prevent static electrical discharges.

BRIEF DESCRIPTION OF THE DRAWINGS

In the drawings, which constitute a part of this specification, exemplary embodiments of the invention are set forth as follows:

FIG. 4 is a side elevational view of the bobbin shown in FIG. 3 as viewed from the side of the closed flexible head portion;

FIG. 5 is an end elevational view, partly in section, of a plurality of bobbins, shown in FIGS. 1–4, joined in interlocking arrangement by insertion of the flexible projection portion of one into the recessed portion of the other;

FIG. 6 is an end elevational view, partly in section and partially broken away, showing an end of braid held in a slot in the hub portion by means of a clamp;

FIG. 6A is a view similar to FIG. 6 showing the hub portion with the braid wound upon it following removal of the clamp.

FIG. 7 is an end elevational view, partly in section and partially broken away, showing a clamp holding another embodiment in which the portion of the hub forming the slot is a thin section; and FIG. 8 is an end elevational view of the embodiment of FIG. 7 showing the clamp tightened to flex the thin section of hub to hold an end of braid.

DESCRIPTION OF THE PREFERRED EMBODIMENTS

As indicated above, detailed illustrative embodiments of the present invention are disclosed herein. However, details of construction and refinements thereof may vary widely and still operate in accordance with the present invention. Consequently, the specific structural and functional details disclosed herein are merely representative; yet in that regard they are deemed to represent the best embodiment for purposes of disclosure and to provide a basis for the claims herein, which define the scope of the present invention.

Figure 1:
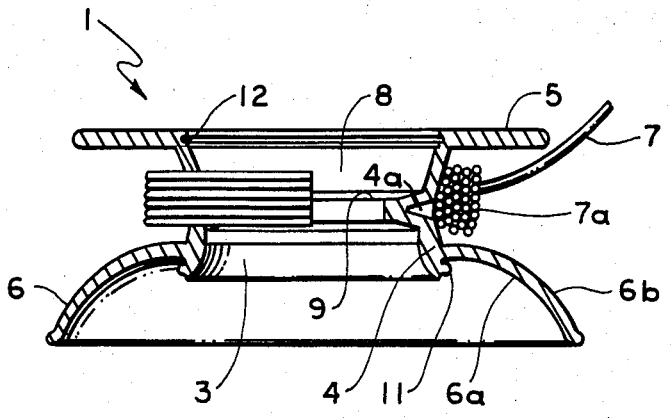
FIG. 1 is an end elevational view, partly in section, of a bobbin embodying the present invention shown with the flexible head portion moved to an open position to permit winding and unwinding of the desoldering braid on the hub portion.

Referring initially to FIG. 1, there is shown a bobbin generally designated by numeral 1. This bobbin 1 comprises a body 3, which may be formed in various shapes such as octagonal or like multi-sided configurations or circular as illustrated. Body 3 includes an elongated central hub portion 4 having a slot 4*a* and a head 5 and 6 at each end of the hub portion for supporting and holding a winding of braid 7 on the hub portion 4 between the heads 5 and 6. Body 3 includes a central aperture 8 extending through the hub portion and heads which has a restricted intermediate portion provided by a ribbed portion 9 formed on the inner surface of the hub portion.

Figure 2:
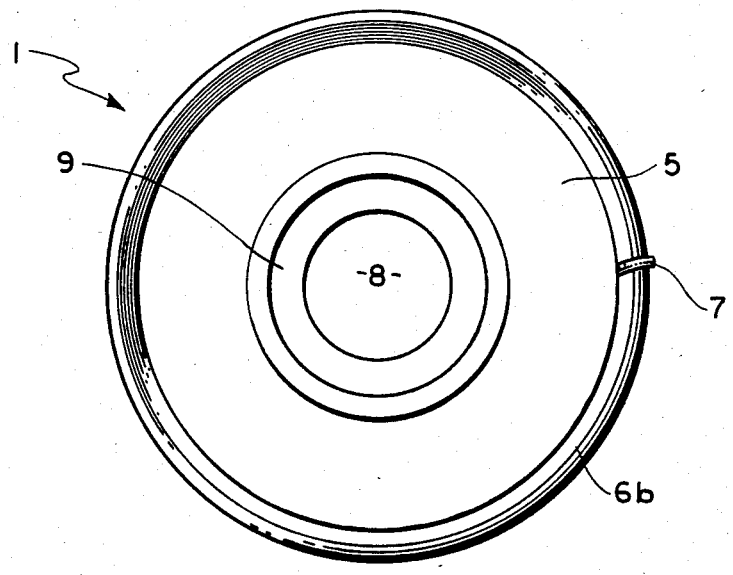
FIG. 2 is a side elevational view of the bobbin shown in FIG. 1 as viewed from the side opposite the open flexible head portion.

Head 5 is substantially flat and extends radially outwardly from the hub portion 4. Head 6 includes a flat inner portion 6*a*, which is generally parallel to head 5, and a curved or curling outer portion 6*b*, which is of a flexible material capable of being shaped or moved from an open position (FIGS. 1 and 2), in which the winding is fully exposed to a closed position (FIGS. 3, 4 and 5), in which the winding is fully covered. In the open position, the flexible portion 6*b* extends or flares outwardly from the associated end of the hub portion to form an essentially concave surface with its outer peripheral edge a substantial distance outwardly from its associated hub portion. In the closed position, the flexible portion 6*b* extends inwardly toward head 5 to from an essentially convex surface having an inner peripheral surface in overlying and close tolerance with the outer peripheral edge of head 5. In this manner the loose end of braid 7 is held in a friction grip between the peripheral edge of the head 5 and the inner peripheral surface of flexible portion 6*b*.

The bobbins 1 are provided with a coupling or interlocking feature, which permits a plurality of similar bobbins to be interconnected in a stacked relationship as shown in FIG. 5. This interlocking feature includes a radially extending projecting portion 11 of a flexible material, preferably cylindrical in shape as shown, at the end of the hub portion adjoining head 6 and outwardly disposed therefrom. The outer dimension of projecting portion 11 is slightly greater than the inner dimension of the central aperture 8, defined by a preferably cylindrical inner surface in the body 3 at the end of the hub portion adjoining head 5, so that the projecting portion 11 may be placed by flexible insertion into the central aperture of a second bobbin. The inner surface of the body defining aperture 8 is preferably of a flexible material to assist in the interlocking function. The central aperture is preferably provided with a mating recessed portion 12 extending radially thereof, having a shape similar to projecting portion 11 of an adjoining bobbin, so that the projecting portion will interlock in the recessed portion.

The head portion 6*b* and the projecting portion 11 may be of various types of flexible plastics. Preferably the entire body 3 is formed in a single mold and of the same material. Polyethylene or polypropylene has been found to provide the best results. This material so formed has been found to provide a durable bobbin, which is sufficiently flexible to permit the head portion 6*b* to be shaped or curled to and from the open and closed positions and the flexible insertion of the projecting portion 11 within the recessed portion 12 many times without breakage or substantial deformation.

Figure 3:
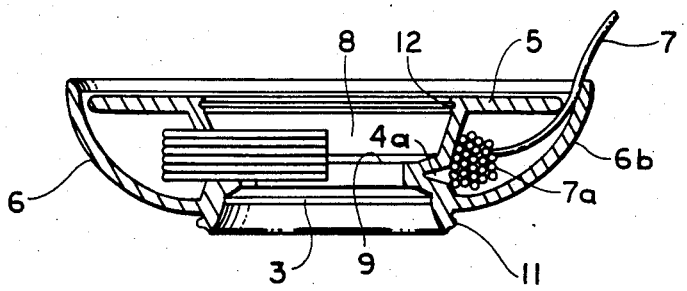
FIG. 3 is an end elevational view, partly in section, of the bobbin shown in FIG. 1 with the flexible head portion moved to a closed position to enclose the winding of braid and hold the loose end of the braid between the peripheral ends of the heads.

The bobbin 1 is provided with a slot 4*a* in hub portion 4. Slot 4*a* is preferably circumferential in order to permit the slot to be narrowed to hold an end of braid by applying pressure to the ends of the hub portion 4 when the bobbin is in the open position illustrated in FIGS. 1 and 2. The width of the slot is advantageously slightly greater than the diameter of the braid at the outer periphery of hub portion 4 to allow the braid end to be inserted into the slot with ease. The sides of the slot can be parallel or can slope inwards in a narrowing configuration, as shown in FIGS. 1, 3 and 5. Application of pressure to the ends of hub 4, such as by means of a clamp 13, as shown in FIG. 6, narrows the slot 4*a* and the distance between heads 5 and 6 and enables an end of desoldering braid 7 to be held securely therein, permitting winding of the braid upon the bobbin without slippage. The wound braid is shown as 7*a*. Release of pressure against the ends of hub 4 results in the slot being restored to its normally widened condition. The space between heads 5 and 6 is also widened as shown in FIG. 6A. The end of desoldering braid 7 is thereby released and the braid 7*a* is supported loosely upon hub portion 4 between heads 5 and 6. The braid can then be removed from the bobbin by pulling straight out without causing unnecessary friction between the braid and the heads of the bobbin.

Thus, the bobbin is capable of firmly holding the end of the desoldering braid during winding to prevent the end from pulling free of the bobbin, and because of the design of the bobbin of the present invention, the braid is permitted to slip upon being pulled straight out to facilitate removal thereof during use. Friction between the braid and the bobbin is also reduced as a result of the braid being loosely supported upon the bobbin.

In the embodiment illustrated in FIGS. 7 and 8, the center part of hub portion 4 is shown as a thin section 4*b* which flexes upon compression to create a groove capable of receiving and holding braid end 7.

In order to prevent electrostatic discharges from occurring as the desoldering braid is removed from the bobbin, by friction between the desoldering braid and the hub and heads of the bobbin, it has been found desirable to fabricate at least the heads of the bobbin from conductive plastic materials. Plastics which are themselves conductive can be used for this purpose. For example, conductive polyethylene or polypropylene compositions available as BENTRON conductive compounds from Bengal, Inc., Los Angeles, Calif. may be used. Alternatively, plastics which have static dissipative properties, such as BENSTAT static dissipative plastic compounds available from Bengal, Inc., Los Angeles, Calif., can be used for this purpose. Such plastic formulations can be molded into the desired form of the finished bobbin heads or bobbins.

The foregoing description of the invention has been directed to particular preferred embodiments for purposes of explanation and illustration. It will be apparent, however, to those skilled in the art, that many modifications and changes in the methods and materials may be made without departure from the scope and spirit of the invention. For example, other slot configurations than those specifically described can be utilized. In addition, other means of rendering the bobbin or heads thereof conductive or other means of dissipating static charge may be utilized. It is applicants' intention in the following claims to cover all such equivalent modifications and variations as fall within the true spirit and scope of the invention.

What is claimed is:

1. In a bobbin for desoldering braid comprising:
a body including a hub portion for holding and supporting a winding of braid;
a first head having a substantially flat portion extending outwardly from one end of said hub portion; and
a second head having a curling portion of a flexible material extending outwardly from the other end of the hub portion and establishing a surface portion overlying and in close tolerance with the peripheral edge of said flat head portion;
so as to enclose a winding of braid on the hub portion when curled inwardly to a first position, and extending outwardly from the hub portion in substantially spaced relation to said first head portion when curled outwardly to a second position, to prevent winding of the braid on the hub portion;
the improvement which comprises:
said hub portion containing a slot wider than said braid for receiving an end of said braid;
said slot and the distance between said heads being capable of being narrowed by applying pressure to the ends of said hub portion to hold securely an end of said braid during winding of said braid upon the compressed hub portion;
said slot and the distance between said heads being capable of being widened to their normal widths by ceasing the application of pressure to the ends of said hub portion, whereby the end of said braid is released from said slot and the braid is supported loosely upon said hub portion between said heads.

2. A bobbin according to claim 1 wherein said slot is a circumferential slot.

3. A bobbin according to claim 1 wherein said slot is a circumferential slot having parallel sides.

4. A bobbin according to claim 1 wherein said slot is a circumferential slot having sides sloping inwards in a narrowing configuration and a width slightly greater than the diameter of said braid at the outer periphery of said slot.

5. A bobbin according to claim 1 wherein at least said first and second heads are comprised of a conductive plastic compound.

6. A bobbin according to claim 1 wherein at least said first and second heads are comprised of a static dissipative plastic compound.

7. A bobbin according to claim 1 wherein said entire bobbin is fabricated from a conductive plastic compound.

8. A bobbin according to claim 1 wherein said entire bobbin is fabricated from a static dissipative plastic compound.

9. In a bobbin for desoldering braid comprising:
a body including a hub portion for supporting a winding of braid;
a first head having a substantially flat portion extending outwardly from one end of the hub portion; and
a second head having a curling portion of a flexible material extending outwardly from the other end of the hub portion and establishing a surface portion overlying and in close tolerance with the peripheral edge of said flat head portion;
so as to enclose a winding of braid on the hub portion when curled inwardly to a first position, and extending outwardly from the hub portion in substantially spaced relation to said first head portion when curled outwardly to a second position, to permit winding of the braid on the hub portion;
the improvement which comprises said bobbin being fabricated from a conductive plastic compound.

10. In a bobbin for desoldering braid comprising:
a body including a hub portion for supporting a winding of braid;
a first head having a substantially flat portion extending outwardly from one end of the hub portion; and
a second head having a curling portion of a flexible material extending outwardly from the other end of the hub portion and establishing a surface portion overlying and in close tolerance with the peripheral edge of said flat head portion;
so as to enclose a winding of braid on the hub portion when curled inwardly to a first position, and extending outwardly from the hub portion in substantially spaced relation to said first head portion when curled outwardly to a second position, to permit winding of the braid on the hub portion;
the improvement which comprises said bobbin being fabricated from a static dissipative plastic compound.

11. A process for winding a length of desoldering braid around a bobbin comprising a body including a hub portion for holding and supporting a winding of braid, and first and second heads, said hub portion containing a slot wider than said braid for receiving an end of said braid, comprising the steps of:
inserting an end of a desoldering braid into said slot;

narrowing said slot and the distance between said first and second heads by applying pressure to the ends of said hub portion to hold securely said braid end;

winding said braid upon the compressed hub portion; and widening said slot and the distance between said first and second heads by ceasing the application of pressure to the ends of said hub portion, whereby the braid end is released from said slot and the braid is supported loosely upon said hub portion between said first and second heads.

12. A process for winding a length of desoldering braid around a bobbin comprising a body including a hub portion for holding and supporting a winding of braid, a first head having a substantially flat portion extending outwardly from one end of said hub portion, a second head having a curling portion of a flexible material extending outwardly from the other end of the hub portion and establishing a surface portion overlying and in close tolerance with the peripheral edge of said flat head portion, so as to enclose a winding of braid on the hub portion when curled inwardly to a first position, and extending outwardly from the hub portion in substantially spaced relation to said first head portion when curled outwardly to a second position, to prevent winding of the braid on the hub portion, said hub portion containing a slot wider than said braid for receiving an end of said braid which comprises the steps of:

inserting an end of desoldering braid: into said slot;

narrowing said slot and the distance between said heads by applying pressure to the ends of said hub portion to hold securely said braid end;

winding said braid upon the compressed hub portion; and widening said slot and the distance between said heads by ceasing the application of pressure to the ends of said hub portion, whereby the braid end is released from said slot and the braid is supported loosely upon said hub portion between said heads.

* * * * *